United States Patent [19]

Paley

[11] 3,994,743

[45] Nov. 30, 1976

[54] CLARIFICATION AND TREATMENT OF SUGAR JUICE

[76] Inventor: Lewis A. Paley, 614 Adams St., Aurora, Ill. 60505

[22] Filed: Nov. 19, 1973

[21] Appl. No.: 417,269

Related U.S. Application Data

[63] Continuation-in-part of Ser. No. 217,725, June 2, 1972, and a continuation-in-part of Ser. No. 482,005, July 1, 1965, Pat. No. 3,808,050.

[52] U.S. Cl. ..... 127/48; 127/2; 127/11; 127/50; 127/55; 127/56; 127/57; 127/61; 210/42 R; 210/52

[51] Int. Cl.[2] ..... C13D 1/00; C13D 3/02; C13D 3/12; C13D 3/16

[58] Field of Search ..... 260/412, 412.4, 412.5, 260/412.8; 127/2, 9, 42, 43, 46 R, 48, 53, 55

[56] References Cited

UNITED STATES PATENTS

| | | | |
|---|---|---|---|
| 57,465 | 8/1866 | Bell | 127/42 |
| 531,460 | 12/1894 | Deming | 127/53 |
| 1,101,940 | 6/1914 | Kopke | 127/56 |
| 1,309,999 | 7/1919 | Bunker | 260/412 |
| 1,314,203 | 8/1919 | Mumford | 127/55 |
| 2,009,522 | 7/1935 | Rosales | 260/412.8 |
| 2,499,008 | 2/1950 | Swenson | 260/412.8 |
| 2,522,797 | 9/1950 | Paley | 127/46 R |
| 3,808,050 | 4/1974 | Paley | 127/55 |

*Primary Examiner*—Morris O. Wolk
*Assistant Examiner*—Sidney Marantz

[57] ABSTRACT

Method and apparatus for treating fresh, unheated sugar cane juice which involves adding a sufficient amount of an aqueous alkaline slurry containing powdered active carbon to the juice to raise the pH of the juice to 6.8–8.5. The resulting mud is separated and a water white juice is obtained. The water white juice is concentrated to form a direct white sugar and an edible molasses having a natural maple flavor and odor. The juice may be subjected to a preliminary cyclone separation and the sugar cane from which the juice is obtained may be subjected to a steam-cleaning operation to remove cane wax and dirt.

5 Claims, 4 Drawing Figures

CLARIFICATION AND TREATMENT OF SUGAR JUICE

Figures 1, 2:
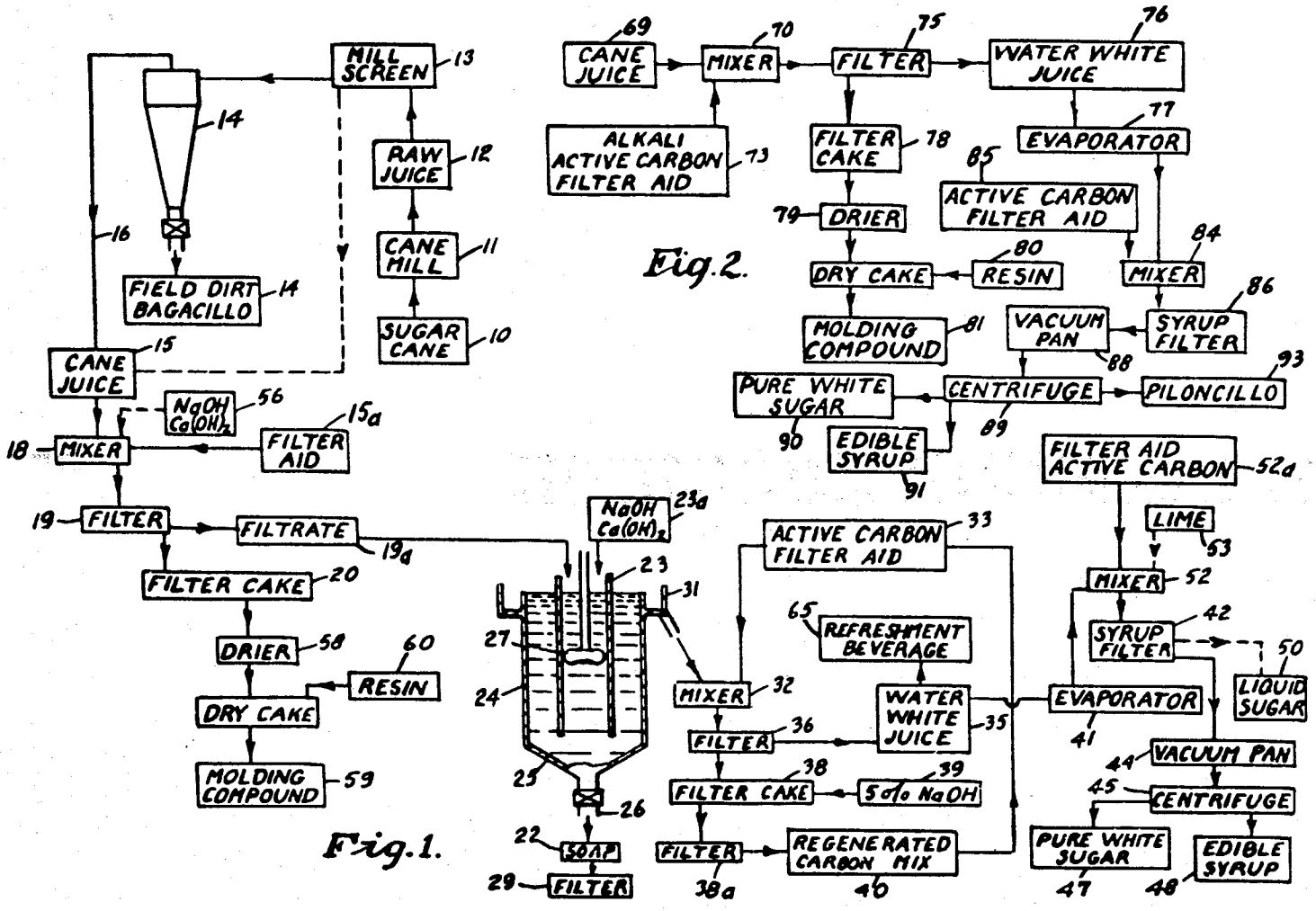

This application is a continuation-in-part of Ser. No. 217,725 filed May 2, 1972; this application is also a continuation-in-part of Ser. No. 482,005 filed July 1, 1965, now U.S. Pat. No. 3,808,050.

This invention relates to the clarification and treatments of sugar juice, and to the production of pure, direct white sugar, beverage, liquid sugar, edible syrup or molasses, and other by-products from the juice.

Sugar cane juice directly from the mill screen contains field dirt, cane wax, fatty acids, bagacillo and other impurities. This juice has a temperature of 20° to 40° C. which is room temperature. The juice streams from the pressing rolls fall through the air several feet and the juice comes to room temperature. No artificial heating of the juice is needed or desired. This fresh juice will have a pH of 5.2 to 5.8. There is a natural cleavage in the fresh juice between sugar and non-sugar impurities and if this cleavage is not disturbed by process conditions, the impurities may be removed from the juice largely by physical means so that water white juice is produced containing mostly sugar and water. This water white juice is then evaporated to produce pure white sugar by crystallization, or liquid sugar. By-products of commercial value are produced from the impurities removed from the juice.

In the conventional process, the cane juice from the mill screen is limed and then is heated to boiling. The cane wax which has a melting point of 175° F., melts when the juice is heated and disperses throughout the juice. Other impurities, such as fatty acids and colored bodies, also melt and disperse throughout the juice. Mud is separated from the juice by hot settling and the resulting "clarified" juice is almost black, and the juice has been ruined by the premature heating. This "clarified" juice is evaporated and inevitably the raw sugar and blackstrap molasses of commerce is produced. This raw sugar is usually shipped to a distant refinery where it is remelted and reprocessed to produce white sugar which is sold to the consumer. The black strap molasses contains 30% sucrose which cannot be crystallized and 30% invert sugar, all of which is largly wasted due to the low price of black strap molasses. The entire process is inefficient and wastful. Just the cost of refining raw sugar is 3 cents per pound of white sugar, and condsiderable sucrose is converted to invert sugar in the hot clarifiers and lost in the blackstrap molasses.

Cane sugar juice has always been considered non-filterable because of the highly gelatinous impurities which it contains. However, I have found that cane juice directly from the mill screen may be readily filtered with a high flow rate if sufficient filter aid (diatomaceous earth is used. This filtration removes many of the impurities contained in the juice, such as field dirt, cane wax, a tarry matter, bagacillo, etc. which are found in the filter cake. Some of the fatty acids pass through the filter so that the filtrate will still have a pH of about 6.0. The sodium soaps of these fatty acids are mostly insoluble in a slightly alkaline solution, so that the sodium soaps precipitate may be removed from the juice by the addition of NaOH or lime to a pH of 6.8 to 8.5, and by settling and filtration. The juice is now mixed with powdered active carbon and optionally filter aid, and filtered to produce a water white juice.

This water white juice may be heated for sterilization and to coagulate albumin, and evaporated in the conventional way to produce pure direct white sugar and light colored edible molasses.

An object of the invention therefore is to produce direct white pure/sugar or liquid sugar directly from the cane juice without refining, this sugar preferably polarizing 100%.

Another object of the invention is to clarify cane juice from the mill screen to water white clarity before heating the juice.

Another object of the invention is to remove impurities in can juice by steps so as not to prevent filtration by an accumulation of gelatinous materials.

Another object of the invention is to clarify cane juice without destrying the natural cleavage between sugar and impurities.

Another object of the invention is to provide a process of treating the juice in which the field dirt is first optionally removed from the juice by cyclone separation or by settling prior to final clarification.

Another object of the invention is to provide a process or method of producing liquid sugar by evaporating said juice to water white condition at a pH substantially below 7.0 to invert part of the sucrose.

Another object of the invention is to clarify unheated cane juice by physical means.

Another object of the invention is to produce new products from cane juice, such as carbonated beverage having a delightful maple flavor.

Another object of the invention is to produce a molding plastic material from carbonaceous material removed from the cane juice.

Another object of the invention is to produce a carbonaceous molding plastic from soft coal.

Another object of the invention is to produce useful molded articles from the carbonaceous sugar impurities and from soft coal, such as boards and studs for construction purposes.

A still further object of the invention is to provide other by-products from the impurities removed from the juice, such as laundry soap; also to improve methods of treating sugar juice and its by-products in other respects hereinafter specified and claimed.

Figure 3:
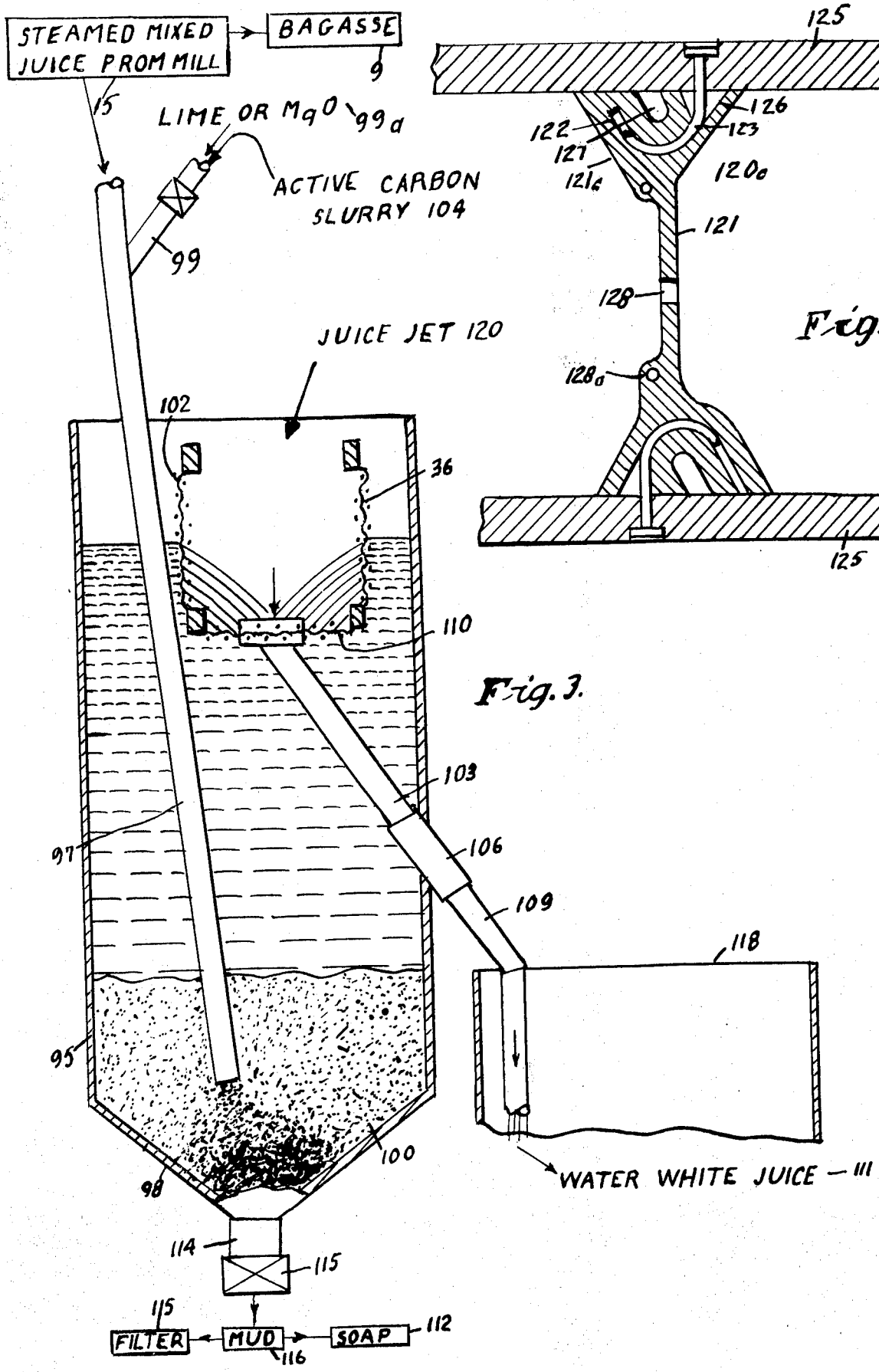
Figure 4:
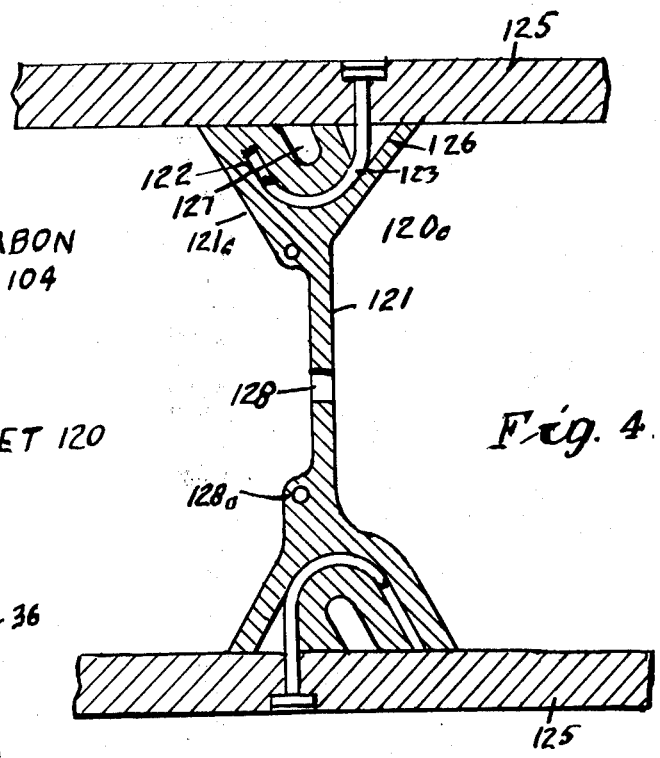

Reference is to be had to the accompaning drawings forming a part of this specification, in which FIG. 1 is a flow sheet of the improved process, dotted lines indicating optional ways of carrying out the process, FIG. 2 is a flow sheet of a simplified form of the process, FIG. 3 is a sectional elevation of an apparatus for carrying out the process, and FIG. 4 is a sectional view of a wall construction of plastic material made from soft coal and the residue from sugar manufacture.

Referring to the drawing by numerals, the sugar cane 10 is run through the conventional roller grinding mill 11 which squeezes the cane juice 12 from the residual bagass, at room temperature. The juice then passes through a mill screen of the scraper type to avoid plugging up. In rainy weather, the sugar cane is brought in from the field with considerable field dirt which remains with the cane juice. This field dirt and bagacillo 14 may be eliminated from the juice under 30 to 100 p.s.i., such as 40 p.s.i. tangentially through a conventional cyclone separator $\mathbf{14}_a$, the partly clarified juice passing upwardly through a pipe 16 from the separator and the field dirt wax and bagacillo passing downwardly from the bottom of the separator $14_a$.

The unheated cane juice 15 at substantially room temperature is optionally mixed with filter aid $15_a$ (diatomaceous earth) in a mixer 18 using about ¼ to 1 liter of filter aid to 40 liters of juice, and chlorine gas or solution may be optionally added to the juice in mixer 18 to kill bacteria and sterilize the juice. The juice is now pumped through a pressure filter 19 at 20–100 p.s.i., such as 65 p.s.i., where the filter aid and many of the impurities in the juice, such as cane wax, bagacillo and some of the fatty acids are removed. A vacuum drum belt filter may also be used for this purpose. A filter cake 20 from the filtration operation contains a tarry liquid of unknown composition which may be isolated by salting out with acetone. The filtered juice will have a pH of about 6.0 if the pH of the fresh juice is 5.2 to 5.8. The acidity of this filtered juice is due to the presence of organic acids. These organic acids may be precipitated as soaps by neutralizing the juice 15 to a pH of 6.8 to 8.5, such as 7.0 pH, by the addition of an alkaline material, such as NaOH or lime, in which case the soaps will be removed by filter 19 and will be found in the filter cake 20. However since these soaps are of a gelatinous nature, it is desirable but not essential, to neutralize the juice after the juice passes the filter 19 in order to maintain a high flow rate in filter 19.

If the neutralization of the juice is postponed until after the juice passes filter 19, a separation of different kinds of fatty acids is effected, some in the filter cake 20 and the rest in the rest in the soap precipitate 22. The filtrate $19_a$ from filter 19 may be passed into the open top of an open cylinder 23 of a settling tank 24 having a conical bottom 25 and a valve controlled bottom pipe 26 for discharging the soap precipitate 22 from from said settling tank 24. NaOH lime are optionally introduced into the top of cylinder 23 to be mixed with the juice by a motor driven propellor 27 so as to raise the pH of the juice to 5.8 to 8.5 and precipitate the soap 22. The soap precipitate 22 may be filtered in filter 29 to free it from most of the juice, said juice being returned to the system. The soap 22 may be mixed with soaps of other fatty acids to make powdered or cake detergents, or may be used for other commercial purposes, such as greases.

The clarified juice from clarifier tank 24 overflows the top of said tank 24 into a launder 31 and then flows to a mixer 32. Active carbon and optionally filter aid 33 are continuously introduced into the mixer 32 to remove the last of colored material and produce water white juice 35. The juice mixture in mixer 32 is pumped through a pressure filter 36 at 30 to 100 p.s.i., such as 65 p.s.i. to produce the water white juice 35 and filter cake 38. The filter cake 38 is regenerated for further cycling and use by mixing a 5% solution of NaOH 39 with the cake and filtering in filter $38_a$. Residual NaOH in the regenerated mix 40 will help in neutralizing any acidity in the juice to which it is added. The filter cake 38 may also and preferably be regenerated to active carbon by calcination. The filtrate from the regenerated mix may be mixed with acetone in excess to precipitate a by-product in the form of a tarry liquid of unknown composition. The regeneration of the filter cake 38 should be done at room temperature since at elevated temperatures the silicious filter aid has a tendency to dissolve in the 5% NaOH solution.

The water white juice may be heated optionally to sterilize the juice and to coagulate the albumin which may be removed by filtration, and is then run into a vacuum evaporator 41 where it is evaporated to a syrup of 50° to 70° brix, such as 65° brix for the production of pure white sugar. It is preferable to filter this syrup hot by mixing it with powdered active carbon and filter aid $52_a$ and pumping it through a pressure filter 42 to remove color and any sediment, such as albumin, which might have been formed by the evaporation of the juice. This syrup from filter 42 is run into a vacuum pan 44 where the evaporation is continued to crystallize out the white sugar. The massecuite from vacuum pan 44 is transferred to a conventional crystallizer and from there to a centrifuge 45 where the white sugar is separated from edible molasses or syrup 48 which has a light color and a natural maple flavor. The white sugar is dried, screened and is ready for bagging and marketing.

If liquid sugar 50 is to be made, the juice may be left at its original pH of about 6.0 or 0.5 such as 6.0 so that inversion of sucrose takes place during the evaporation in evaporator 41 to produce a final invert sugar content in the liquid sugar of about 50% to prevent crystallization of sucrose in the container. The liquid sugar is then pumped hot under pressure through a pressure filter 42 to produce the liquid sugar 50.

In times of dry weather when the cane from the field is clean, the cyclone separator $14_a$ may be bypassed and the cane juice run directly from the mill screen 13 to the mixer 18. If it is desired to bypass the settler 24, NaOH or lime 56 may be added to the juice in mixer 18 to a pH of 6.8 to 8.5 and the resulting soap 22 will be removed in filter 19. The water white juice 35 may be sterilized by heating and bottled to be served as a refreshment beverage 65 of delightful maple flavor. It is better to reduce the sugar content of the beverage to 6% by dilution with water about 1-1. The juice may be carbonated with carbon dioxide if desired. Flavor materials may be added to this cane juice before bottling.

The filter cake 20 from filter 19 may be dried in dryer 58 to form a molding plastic material 59. This dried cake is preferably mixed with powdered phenol-formaldehyde thermosetting resin 60, or a thermoplastic resin such as polyethylene or polypropylene, in the proportion of one part by weight of resin to 5–15 parts of filter cake. The mixture may be ground to mix it to a powder and is ready for molding to many useful articles, such as the studs and boards to be described. The molding powder produces a copolymer by the combined heat and pressure in a closed steel mold to produce a molded article comparable to Bakelite in mechanical and electrical properties. The filter aid and bagacillo in the molding compound act as fillers. The production of molded articles from the filter cake 20 offers a profitable way of utilizing this filter cake without further processing so as to more than pay the cost of processing the sugar juice. The dried filter cake 20 may be alternately extracted with heptane, hexane or acetone to isolate the light colored cane wax from the extract by the evaporation of the solvent. The residual cake may also be used for a plastic. The filter cake 20 may also be mixed with 5% NaOH to dissolve by-product material from the filter cake 20. The NaOH solution may be mixed with an excess of acetone to salt out a tarry liquid by-product of unknown composition. Filtration of the juice may also be used instead of the settling apparatus, or a combination settling and filtration apparatus to be described.

In the short process of FIG. 2, only one filtration of the juice is required. The active carbon in the filter cake 78 has the surprising effect of insolublizing the cane wax in the filter cake, so that the cane wax is insoluble in a solvent, such as heptane, hexane, acetone or NaOH. The cane wax in filter cake 20 which contains no carbon, may be readily extracted with a solvent. The filter cake 78 may be regenerated by dissolving impurities with a 5% NaOH solution, or by calcination, and then regenerated cake may then by recycled.

Piloncillo 93 may be made from the massecuite in the centrifugal 89 by operating the centrifuge at about one half the normal speed as to remove one half the syrup from the granulated sugar crystals. The resulting mass of sugar crystals, and some syrup, is introduced into piloncillo molds to cool down to solid piloncillo. The piloncillo is a frustoconical shaped confection sold in some countries as a substitute for sugar. Other shapes may be molded if desired. By removing some of the syrup, the piloncillo will have sufficient rigidity to resist distortion in hot tropical countries. The piloncillo or other confections may be coated with chocolate if desired.

In the short process of FIG. 3, only one filtration of the juice is required. The simplest form of apparatus will be used. The cane juice 69 from the mill screen will be run to mixer 70. An alkaline material such as NaOH or lime will be optionally introduced into mixer 70 to bring the pH of the juice to 6.8 to 8.5. Active carbon and optionally filter aid 73 will then be added to Mixer 70, preferably in slurry from suspended in clarified juice. When mixing is complete the juice mixture will be filtered in filter 75.

The apparatus shown in FIG. 3 is preferably a modified form of tank 24 in which filter 36 is made a part of said tank 24 for economy, convenience and speed of operation. This apparatus is also suitable for carrying out the process described for FIG. 2. This modified form of apparatus is also suitable for the making of laundry soap as a byproduct from the juice by first removing the field mud, bagacillo and other impurities, or by first removing the wax and field mud, bagacillo and other impurities, by steaming the moving cane on a conveyor as disclosed in my patent application Ser. No. 217,725 filed May 2, 1972, entitled "Treatment of Sugar Cane" of which this application is a continuation in part. This application is also a continuation in part of my application Ser. No. 482,005 filed July 1, 1965 entitled "Clarification and Treatment of Sugar Juice", now U.S. Pat. No. 3,808,050 Apr. 30, 1974.

The standard sugar factory has a liming tank in which lime is added to the juice from the mill in order to precipitate impurities from the juice. These impurities are almost invariably kept in suspension in the juice by agitation with compressed air or by mechanical agitation, and the mixture is heated to boiling in steam juice heaters which melts the wax in the juice, throws it into solution, and ruins the juice so that only raw sugar and blackstrap molasses can be produced. With my improved process, the liming tank may be modified with attachments and with very little expense, to make combination juice settler and filter so that substantially all of my clarification process may be carried out in the cold in a single piece of equipment, making a very compact and efficient operation.

In my process, the steaming of the cane on the factory entering conveyor, removes the field dirt, wax, gums, bacteria, trash etc., from the cane leaving it perfectly clean and sterile as it goes to the shredder and then to the mill. The steam serves to heat the cane and juice temporarily, but their temperature largely returns to room temperature as the cane goes through the mill rolls and shredders and then falls as streams of juice from the mill rolls through the air. Some slight temperature may remain in the juice but this temperature will do no harm as the wax has been removed by the steam cleaning so that no wax is present to cause complications in the subsequent clarification of the juice. The steam formerly used in the juice heaters will now be available for the steam cleaning operation.

In the liming tank 95 now existing as standard equipment and is tall and cylindrical, can now be used as a cold settling tank to settle out suspended matter from the juice and then used for filtering the juice all in one operation. This equipment would serve as filter 75 but with a combined settling and filtration function. An intake pipe 97 extends from above the tank 95 to a point near the bottom 98 which is preferably conical in shape. The sugar juice from the mill coarse screen is run into the pipe 97. A branch pipe 99 is connected near the top to pipe 97 to introduce an alkaline material, such as a slurry of lime or MgO $99_a$ into the pipe 97 so as to mix said alkaline material with said juice to cause a precipitate in said juice of impurities, such as field dirt, wax, bagacillo, soaps etc. which settles to the bottom 98 as a precipitate layer 100, thus serving as a sludge filtering layer which serves to remove more impurities from the juice. The clarified juice rises upwardly above the precipitate layer 100 of mud and flows upwardly to the filter 36 to pass through the filter fabric walls 102 of said filter as a filtrate which passes through a diagonal outlet pipe 103 to flow from the filter.

The pipe 103 is preferably made of plastic to, withstand the highly corrosive action of powdered active carbon suspended in water, on metals. A coupling 106 of steel protected with anticorrosive paint, may be welded to the wall of tank 95 to receive the threaded ends of pipe 103 and a further pipe 107 screwed into the coupling 106. The filter 36 is framed by strips of wood or other material to which the filter fabric 102 is secured as by nailing, to form the box-like gravity filter having side walls 102, bottom 110 and end walls, not shown. The filter fabric may be of woven cloth or woven plastic of polypropylene or polyethyene of about 50–80 mesh, to filter out any remaining impurity from the juice and produce a highly cold clarified or water white juice 111 all in one operation, and in one piece of equipment. If the cane has been steam cleaned on the entering conveyor as disclosed in my application Ser. No. 217,725, there will be little or no wax, field dirt, or trash passing through pipe 97, and the filtered juice leaving pipe 109 may be treated with NaOH to produce laundry soap 112 which may be compounded with soda ash or other material, and the soap may be sold in cake form or in granular form as a general laundry soap. This soap is made by the reaction of NaOH on the organic acids in the cane juice.

If the cane is not steam cleaned, the juice will contain considerable cane wax in suspension which combines with the active carbon to make a highly insoluble wax-carbon compound which settles rapidly in tank 95 to the bottom 98. An outlet pipe 114 is provided on bottom 98 and said pipe 114 is provided with a control valve 115 so that the mud 116 may be intermittently or continuously discharged from the tank 95 for processing. The mud 116 preferably goes to a rotary filter 117 to remove the juice in said mud for processing to recover sugar values. If only field mud is removed in tank 95, a tank 118 and gravity filter similar to 36 may be provided, to remove soap and other impurities from said juice in said second tank, and the product will be water white juice 111 which will be evaporated and processed to produce direct white sugar 47 and edible molasses 48, or liquid sugar 50. The steps in the process are like those described for FIG. 2. A cake will form on the outside of filter 36, and the flow of juice may then be stopped every 1–10 hours to remove the cake by a juice high pressure jet 120 to knock off cake pieces from the outside of filter 36 which drop down through the juice to bottom 98 and are removed from the tank through pipe 114. If some or all MgO $99_a$ is introduced into the juice through pipe 99 instead of of lime, it will serve to prevent encrustation of the evaporator heating surfaces from becoming scaled up and will avoid an expensive weekly shut down of the factory with a run the entire grinding season.

I have also found that plastic compounds similar to the carbonaceous residues from sugar juice, may be formed from soft coal as the major ingredient plus 10–20% phenol formaldehyde resin, a fibrous material like sawdust and calcium stearate as a mold lubricant. In such a composition, it is best to give the partly powdered soft coal a roasting treatment at 200°–450° F. for 1 hour as it improves the mechanical strength of the molded piece. The roasted coal is cooled to room temperature prior to grinding it with the other ingredients of the composition.

The plastic compositions may be molded into numerous shapes both for mechanical and electrical purposes. Among the most important uses is for making studs and boards for construction purposes in walls, roofs and floors. The raw material of carbon, such as soft coal and sugar cane carbonaceous residue, are available in enormous quantities. Soft coal screenings are available at the mine for about ½ cents per pound and sometimes are available for nothing for the cost of hauling. These soft coal screenings constitute about 85–90% of the weight of the finished molding compound so the coal composition can easily undersell competing compositions. The composition is thermosetting, so as wall studs they do not melt at the time of a fire in the building, whereas wood 2 inches × 4 inches burn up completely and the building lies in ruins after a fire. The soft coal is left as a result of Noah's flood which buried the immense tropical forests and converted them into soft or bituminous coal. The soft coal contains 30–40% volatile matter and under the combined heat and pressure in a steel mold, it combines with the phenol-formaldehyde resin in the composition to greatly improve the binding properties to make mechanically strong and electrically insulating molded articles. The molded building studs and boards are weather resistant and need only be painted with house paint to improve their appearance.

FIG. 4 shows a fragmentary sectional view of a wall section including the coal plastic nailing stud and facing boards.

A typical formula for the molding composition of soft coal is as follows;

No. 1

50 lbs. of roasted and cooled bituminous coal.
0.5–1-lb. zinc stearate
0.5–1-lb. hexa(hardening agent, hexa methylenetetramine)
0.5–1-lb. sawdust
5–9 lb. phenol formaldehyde resin.

No. 2

50 lbs. preheated and cooled ground bituminous coal.
5–40 lbs. phenol formaldehyde resin.

In FIG. 4 the extruded plastic stud 120 of soft coal composition has a web 121 of ⅛–⅞ inches thickness depending on the width of the stud which may be 3 inches to 12 inches depending on the load to be carried and the use. Along each edge is an enlarged bulb 121 having a full length circular clinching slot 122 for receiving a driving nail 123 having a driving head 124. As the nail is driven into the slot 122, it curves around the slot 122 and clinches to the stud so as to firmly attach the wall board 125 to the stud 120. It is customary to use boards 4 feet × feet for a wall construction and if a joint between two boards occurs adjacent the slot 122, a larger head nail 123 should be used to insure firm attachment of the boards 125 to the stud 120. The outer ends of slots 122 are provided with a tapered surface 126 to insure that the nail enters the slot 122. A chalk line may be applied to the outside face of wall board 125 to insure that all the nails 123 line up properly with the slot 122. An opening 127 may be provided in the stud to provide approximately uniform thickness of material in the bulb 121 so that the stud will extrude properly in the extrusion die. Holes 128 for electrical wiring convenience in the builing are formed in the web 121 by drilling or punching. A pair of reinforcing wires **128*a* may be embedded in the stud 120 at the time of extrusion if desired. The stud 120 may be formed of extruded aluminum instead of the coal plastic at considerably more expense. The outer wallboard 125 should be formed of the coal plastic by extruding the board between pairs of heated rollers. The plastic board has a high weather resistance. The inner board may be made of gypsum if desired at more expense. The Plastic boards may be painted on their exposed surfaces for a good appearance. The stude 120** may be used in furniture manufacture and for walls, floors and roofs of building if so desired.

I have found that I can profitably use a thermoplastic resin instead of a thermosetting resin for use in injection or extrusion molding machines. This resin may be polyethylene, polypropylene, etc. When such a thermoplastic resin is used, I find it possible to avoid the preheating and cooling of the coal without too much sacrifice in compressive strength of the molded articles, and only whole ground coal may be used. The resin is mixed with the ground coal and reground to insure that all lumps of resin are broken up and thoroughly mixed with the coal. The resin is preferably finely divided polyethylene which is obtained by separation in air or water. The finely divided resin mixes easier with the ground coal than the larger pellet size resin.

No. 3 formula.

A formula for the thermoplastic molding compound is as follows;

50 lbs whole ground and unpreheated soft coal.
0.2 to 1.0 lb. finely divided polyethylene resin
Grind to mix for molding purposes.

The molded articles from Formula No. 3 is very high in impact strength and somewhat flexible. The impact strength may be further increased by adding a fibrous material, such as bagasse 9 in an amount of 0.1 to 0.3 lbs. per 50. pounds of Coal. This bygasse 9 should be oven dried to a low moisture content and then added to the ground coal formula and mixed by grinding with the resin. The stud 120 may also be made from the dried mud 115, and the presence of lime in the carbon at the time of calcination and regeneration of the mud 116 is advantageous in promoting the calcination reaction.

The bagasse 9 may also be converted to a high grade active carbon by calcination in my calciner disclosed in my pending application Ser. No. 491,166, filed Sept. 23, 1965, of which this is a continuation in part. This active carbon from bagasse has about 2½ times the decolorizing power of the commercial active carbon sold as "Norite". The bagasse may also be converted to paper, construction boards and table syrup. Lime in the mud is desirable at the time of the calcination of the mud 116.

The bagasse may also be converted to table syrup by the action of concentrated sulfuric acid on the bagasse 9, diluting with water, boiling, neutralization, and evaporation, active carbon being used to remove impurities in the syrup.

Levulose and crystalline dextrose may be made from the edible molasses 50 by crystallizing out the dextrose from the levulose.

Piloncillo may be made from the massecuit 8 as previously disclosed herein.

Pure cane wax may be removed from the cane by steam cleaning the cane as previously disclosed herein. The production of laundry soap has also been described above, as well as studs and wall boards made from the mud 116. Applicant has identified 40 new products made as a result of the new process of sugar manufacture from the sugar cane.

This plastic is a profitable way to utilize high sulfur coal from Illinois and other states, which are not now favored as a fuel as they pollute the atmosphere by reason of their sulfur content.

I would state in conclusion that while the examples illustrated and described constitute practical embodiments of my inventions, I do not wish to limit myself precisely to these details, since manifestly the same may be considerably varied without departing from the spirit of the invention as defined in the appended claims.

Having thus described my inventions, I claim as new and desire to secure by Letters Patent:

1. The method of treating fresh, unheated sugar cane juice which comprises adding an aqueous slurry comprising (a) an alkaline material selected from the group consisting of lime, NaOH and mixtures thereof, (b) powdered active carbon and (c) water to said cane juice, said amount of added aqueous slurry being sufficient to raise the pH of the sugar juice to 6.8 to 8.5, settling the resulting mud and separating the resulting water white juice from said settled mud.

2. The method of claim 1 wherein said water white juice is concentrated to form direct white sugar and edible molasses, said molasses having a natural maple flavor and odor.

3. The method of claim 1 wherein the sugar juice is subjected to cyclone separation prior to adding said aqueous slurry to said sugar juice.

4. The method of treating sugar cane juice as described in claim 1 wherein the water white juice is filtered and then concentrated to form direct white sugar and edible molasses having a natural maple flavor and odor.

5. The method of claim 1 wherein the sugar cane, from which the sugar cane juice is produced, is steam cleaned to remove cane wax and dirt.

* * * * *